United States Patent [19]

Blair

[11] Patent Number: 5,062,529

[45] Date of Patent: Nov. 5, 1991

[54] ENCLOSURE FOR CURLING IRON OR SIMILAR ARTICLE

[76] Inventor: Connie D. Blair, 5073 Madison St., Gary, Ind. 46408

[21] Appl. No.: 271,330

[22] Filed: Nov. 14, 1988

[51] Int. Cl.[5] ..... B65D 85/20

[52] U.S. Cl. ..... 206/349; 219/222; 219/225

[58] Field of Search ..... 206/349, 320; 38/142; 219/222, 242, 225

[56] References Cited

U.S. PATENT DOCUMENTS

| | | | |
|---|---|---|---|
| Re. 16,442 | 10/1926 | McArdle | 38/142 |
| 2,067,830 | 1/1937 | Depew | 220/367 |
| 2,092,445 | 9/1937 | Doulgheridis | 220/367 |
| 2,108,581 | 2/1938 | Duffy | 38/2 |
| 2,439,004 | 4/1948 | Hurley | 38/142 |
| 2,514,400 | 7/1950 | Larkins | 38/142 |
| 3,371,975 | 3/1968 | Meltzer | 206/349 |
| 3,534,392 | 10/1970 | Trouilhet | 219/225 |
| 3,946,196 | 3/1976 | Waters et al. | 219/222 |
| 4,135,868 | 1/1979 | Schainholz | 206/438 |
| 4,159,773 | 7/1979 | Losenno | 211/89 |
| 4,267,430 | 5/1981 | Downey | 219/225 |
| 4,470,518 | 9/1984 | Stein | 206/346 |
| 4,570,792 | 2/1986 | Conway | 206/349 |
| 4,717,020 | 1/1988 | Viira | 220/349 |

FOREIGN PATENT DOCUMENTS

| | | | |
|---|---|---|---|
| 0148496 | 5/1981 | German Democratic Rep. | 219/242 |

*Primary Examiner*—Jimmy G. Foster

*Attorney, Agent, or Firm*—Barnes & Thornburg

[57] ABSTRACT

An enclosure for a curling iron or similar article, such as a soldering iron, which includes a partition member to separate the potentially hot elongate heatable element portion and heat insulated handle of the curling iron from the insulated electrical power cord and electrical outlet plug of the curling iron. The enclosure may be mounted on a vertical surface such as a wall or, alternatively, may be placed on a horizontal surface such as a vanity countertop. A cover portion including ventilation means may be removably attached to the enclosure to secure and protect the contents of the enclosure.

21 Claims, 3 Drawing Sheets

ENCLOSURE FOR CURLING IRON OR SIMILAR ARTICLE

BACKGROUND AND SUMMARY OF THE INVENTION

The present invention relates generally to a new and novel enclosure for curling irons and similar articles such as soldering irons. More particularly, the present invention relates to an enclosure which may be mounted on a wall, or placed on a countertop to hold and secure a curling iron or similar article when such curling iron or similar article is not in use.

The concept of a curling iron as a useful tool for the styling and curling of hair, and its use in various types of hair treatment is well-known. Curling irons are often utilized daily in the home, in beauty salons and at hair care centers to create and touch up hair styles. Because of their reasonable cost, compact style and effectiveness in curling hair, curling irons have achieved overwhelming popularity.

While specific features of the design and construction of curling irons are subject to the individual criteria of the several commercial manufacturers, various components are generally consistent among the various models. A curling iron generally consists of an elongate heatable element attached to a heat insulated handle. The heat may be provided by an external heating element which typically surrounds and soaks the elongate heatable element until it reaches a desired operating temperature. A curling iron of this type is disclosed and described in U.S. Pat. No. 3,946,196 to Waters et al. A disadvantage of the type of curling iron which utilizes an external heating source is that the heat dissipates during use, normally requiring numerous delays while waiting for the elongate heatable element to again be brought up to the desired temperature, or alternately, requiring the use of two curling irons, one to be used while the other is being brought up to the desired operating temperature.

A second method of providing heat for a curling iron is to utilize an electrically resistive heating element interior to the elongate heatable element. In this type of model, an electrical power cord normally extends through the heat insulated handle portion and contains an adequate length of insulated electrical wire and an electrical outlet plug compatible with a standard household electrical outlet. This type of curling iron is preferred by many individuals since the operating temperature is maintained at a consistent level as long as electrical power is provided. This eliminates the necessity of occasionally stopping and waiting for an external heat source to bring the elongate heatable element up to a desired operating temperature or the necessity of alternating between two curling irons as required with the external heating source models.

After use, the elongate heatable element in a curling iron will retain heat for a significant period of time even after the curling iron has been turned off by means of a switch or by unplugging the unit from the electrical outlet. This retained heat can potentially burn or cause injury or pain to individuals, particularly children, who unknowingly handle the elongate heatable element of the curling iron while it is still hot. The retained heat in the elongate heatable element is also capable of charring and damaging the insulative coating on the insulated electrical power cord and electrical outlet plug. In addition, the heat retained in the elongate heatable element may be brought in contact or close proximity to countertops, sinks or vanities on which it is left to cool potentially charring or damaging their surfaces. An additional danger is the fire hazard such a hot elongate heatable element may cause upon contact with flammable materials such as facial tissues, curtains, clothing, linens or other items commonly used in close proximity to a curling iron. This fire hazard is particularly acute since the curling iron is often the last item used in a bathroom, and will often remain unattended for a long period of time. This fire hazard is especially acute when an individual using a hair curler inadvertently forgets to turn off the switch or unplug the unit, causing the elongate heatable element to stay at a high temperature while unattended, in many cases overnight or for a weekend at a time.

It should be noted that an individual using a soldering iron for soldering electrical components or a hobbiest using a soldering iron for various projects may encounter these same types of problems encountered by users of curling irons.

Accordingly, an object of the present invention is the provision of an enclosure for a curling iron or similar article such as a soldering iron to provide convenient, safe storage of such items when they are not being used.

Another object of the present invention is to provide an enclosure into which a curling iron or similar article may be placed while still hot and minimize the risk and danger of injury to individuals, damage to other objects and the hazard of fire.

A further object of the present invention is to provide an attractive and compact enclosure for a curling iron or similar article which can be readily mounted on a wall or alternatively placed on a countertop or work bench to secure and hold a curling iron or similar article when it is not in use.

A still further object is to provide an enclosure for a curling iron or similar article which separates the heat insulated handle and elongate heatable element from the insulated electrical power cord when stored, and further includes a means for retaining the curling iron or similar article at a specific location within the enclosure.

Still another object is to provide an enclosure for a curling iron or similar article which provides air circulation and heat ventilation out of the enclosure to allow for expected cooling of the curling iron or similar article.

And still a further object is to provide an enclosure for curling irons which is economical to produce while being durable in construction.

These and other objects of the present invention are attained by the provision of an enclosure fabricated from a plastic material formed in a generally rectangular configuration for receiving and securing a curling iron or similar article. A partition member separates the enclosure into a first section where the elongate heatable element and heat insulated handle are stored and a second section where the insulated electrical power cord is stored. Mounting holes are preferably provided in the base of the enclosure for securing the enclosure with screws or other suitable fasteners to a wall or other vertical surface. Alternatively, the enclosure may be placed directly onto a counter top or other horizontal surface. A spring-biased clip and retention ring are preferably provided to assist in securing the curling iron or similar article at a specific fixed location within the enclosure.

The enclosure of the preferred embodiment of this invention includes a cover with elongate projections which are slideably received into tracks on the enclosure base to securely receive the cover. In other preferred embodiments, the cover is pivotably attached by hinges along one edge and the cover is secured by means of a closure utilizing magnetic force, a hook and loop fastening means, such as that commonly distributed under the tradename VELCRO, or other suitable closure means. The cover preferably includes a plurality of openings or louvers to provide ventilation and air circulation, and a handle to assist in the opening and closing of the enclosure.

Other objects, advantages and novel features of the present invention will become apparent from the following detailed description of the invention when considered in conjunction with the accompanying drawings.

DETAILED DESCRIPTION OF THE DRAWINGS

Figure 1:
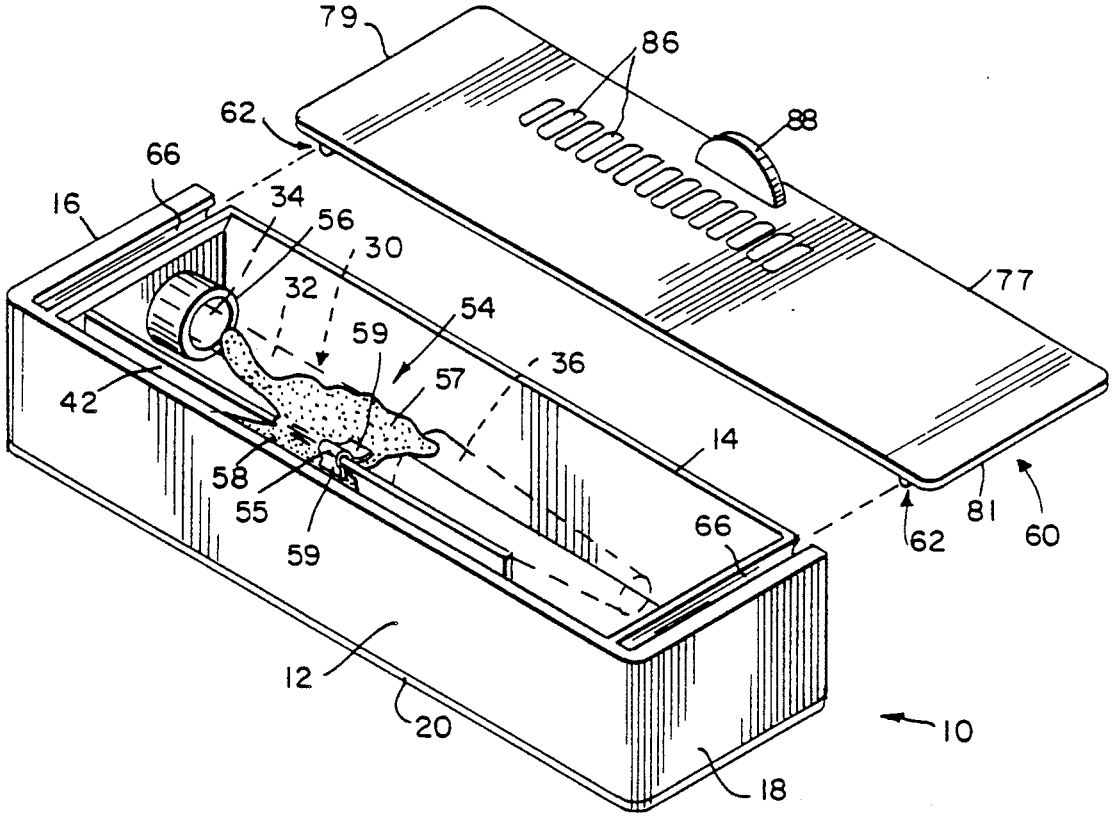
FIG. 1 is a perspective view of a preferred embodiment of the present invention as it would appear when having a curling iron stored therein.

Referring now to the drawings, in which like referenced characters indicate corresponding elements throughout the several views, attention is first directed to FIG. 1 which illustrates a preferred embodiment of an enclosure for a curling iron or similar article. The enclosure is generally rectangular and consists of a base portion 10 and a cover portion 60. The base portion 10 includes a front member 12, a back member 14, and two side members 16 and 18. Attached to the bottom of the front member 12, the back member 14, and the two side members 16 and 18, is a floor member 20. Although the preferred embodiment utilizes a generally rectangular configuration, it should be recognized that other convenient geometric shapes, such as circular, triangular or other configurations can also be readily utilized.

A representative curling iron shown generally as 30 includes an elongate heatable element portion 32 which has a free or tip end 34. The other end of curling iron 30 is attached to a heat insulated handle 36. An insulated electrical power cord 38 extends from the end of the elongate heatable element 32 through a bore in the center of the heat insulated handle 36 and extends away from the heat insulated handle 36 to terminate with an electrical outlet plug 40. The electrical outlet plug 40 is designed to be compatible with a standard household electrical outlet (not shown). Also, curling irons may include an insulated electrical power cord which is coiled similarly to that of a telephone cord. This type of cord reduces the necessity of doubling and redoubling the cord as required when storing a standard insulated electrical power cord in a compact manner.

In preferred embodiments of the present invention, a partition member 42 is positioned within the enclosure so as to divide the base portion 10 into a first section 44 and a second section 46. Preferably, the partition member 42 is attached to at least one of side member 16 or bottom member 20, or to both side member 16 and bottom member 20. The elongate heatable element portion 32 and heat insulated handle 34 are preferably positioned between the back member 14 and the partition member 42 in the first section 44, while the insulated electrical power cord 38 and the electrical outlet plug 40 are positioned between the front member 12 and the partition member 42 in the second section 46. The partition member 42 serves to separate the potentially hot elongate heatable element portion 32 from the insulated electrical power cord 38 and the electrical outlet plug 40, thus minimizing the risk of burning and damaging the insulative coating on the insulated electrical power cord 38 and electrical outlet plug 40.

In preferred embodiments, another function of partition member 42 is to provide clearance around the elongate heatable element portion 32 when the curling iron 30 is secured in base portion 10 to permit air circulation around the potentially hot elongate heatable element portion 32. Often it will be desireable for such air circulation to evenly dissipate that heat. Therefore, partition member 42 preferably extends substantially parallel to the elongate heatable element portion 32 and that elongate heatable element portion preferably extends substantially parallel to back member 14 when the curling iron 30 secured in base portion 10. Also, partition member 42 is preferably offset towards front member 12 to provide adequate clearance for air circulation around elongate heatable element portion 32. The partition member 42 can also include means for the insulated electrical power cord 38 to extend from the end of the heat insulated handle 34 in the first section 44 into the second section 46 where the insulated electrical power cord 38 is stored. Therefore, partition member 42 preferably extends approximately three-fourths of the length of the enclosure from side member 16 to side member 18. However, it should be recognized that other angles and lengths of partition member 42 can be readily utilized to effectively separate the heat insulated handle 36 and the elongate heatable element portion 32 from the insulated electrical power cord 38 and electrical outlet plug 40.

In preferred embodiments, a clip 54 is removably attached to the partition member 42 and includes a center portion 55, and two wing members 57 and 58 which extend outwardly from center portion 55 substantially perpendicular to partition member 42. In an alternative preferred embodiment, the center portion 55 of clip 54 is fixedly attached to the partition member 42, and the wing members 57 and 58 are pivotably attached to the center portion by means of a spring hinge 59, which preferably pivots outwardly away from the floor member 20 and is normally held by a biasing spring in a position substantially perpendicular to the partition member 42. The wing member 57 is positioned to removably secure the heat insulated handle 36 in the first section 44 and the wing member 58 is positioned to removably secure the insulated electrical power cord 38 in the second section 46. The combined height of partition member 42 and the clip 54 is preferably less than the respective height of the front member 12, the back member 14 and the side members 16 and 18 to provide clearance between the assembly of partition member 42 with the clip 54 installed and the cover portion 60.

In preferred embodiments, a tubular or cylindrical retention member or depression 56 is positioned on the side member 16 in first section 44 to secure and positively locate the free or tip end 34 of the curling iron 30 when the curling iron 30 is positioned in the base portion 10. Preferably, the retention member 56 is positioned to secure the elongate heatable element portion 32 in a location such that clearance exists between the elongate heatable element portion 32 and the floor member 20, back member 14, partition member 42 and cover portion 60 so that air circulation is maintained around the elongate heatable element portion 32. Where the curling iron so retained has an insulating tip on the free end of the elongate heating element portion 32, retention member 56 preferably does not extend past that tip.

Figure 3:
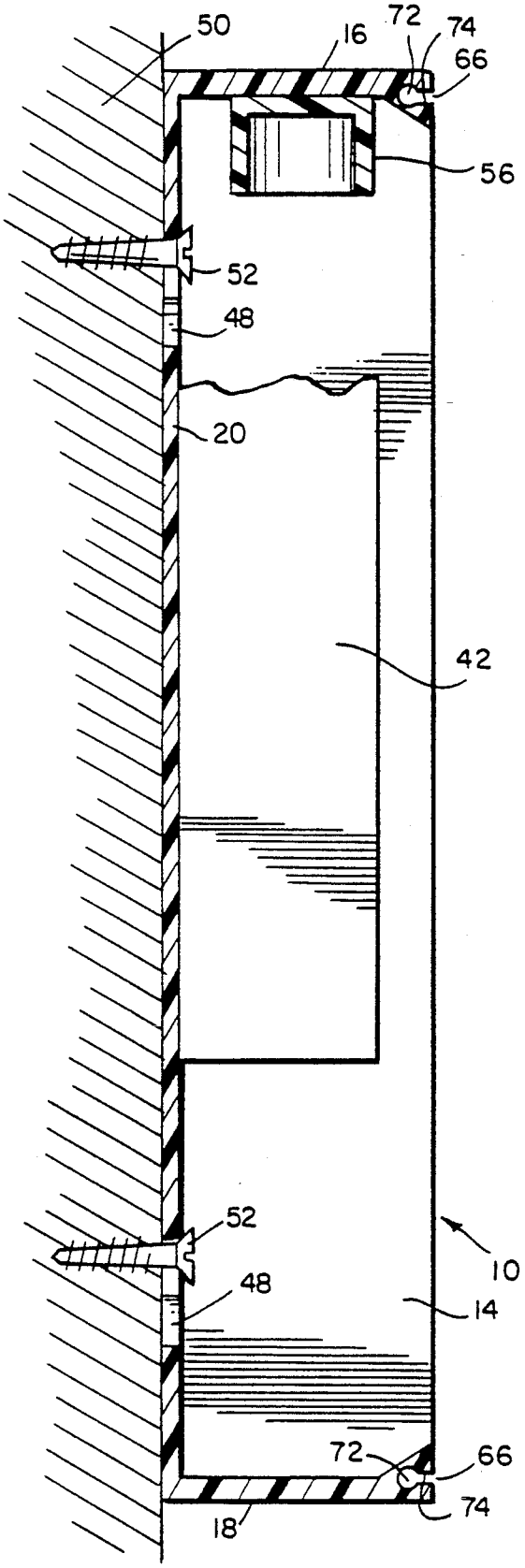
FIG. 3 is a cross-sectional view taken across lines A—A of FIG. 2 as mounted on a vertical surface such as a wall.
Figure 4:
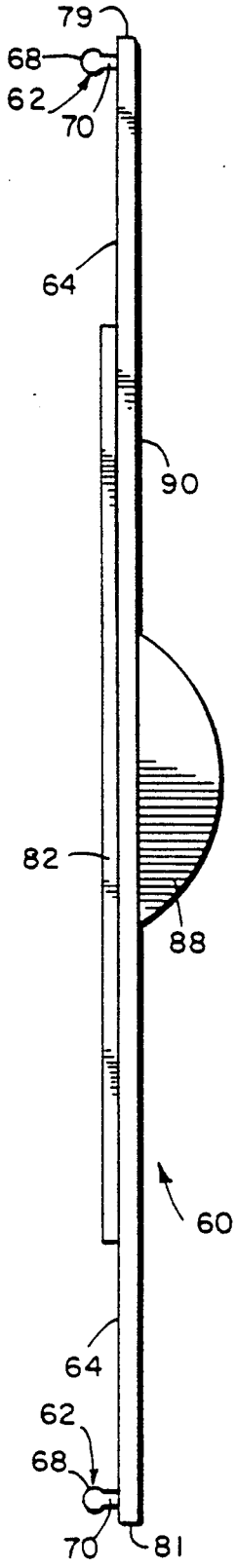
FIG. 4 is a side view of the cover portion using a runner and track arrangement according to the embodiment shown in FIG. 1.

Mounting holes 48 are located in the base portion 10 for mounting the base portion 10 upon a wall or other vertical surface 50 as shown in FIG. 3. Screws or other suitable fasteners 52 can be utilized for insertion through the mounting holes 48 to the secure base portion 10 securely to a wall or other vertical surface 50.

In preferred embodiments, the cover portion 60 is substantially similar in configuration to the top of front member 12, back member 14 and side members 16 and 18 of base portion 10. The cover portion 60 includes a forward edge 76, a rear edge 77 and two side edges 79 and 81, along with a bottom surface 64 and a top surface 90.

Preferably, the cover portion 60 includes runners or elongate projections 62 positioned on the bottom surface 64 and extending axially along side edges 79 and 81. The elongate projections 62 are slideably received into tracks 66 positioned in the top surface of and extending axially along side members 16 and 18 in the base portion 10. The elongate projections 62 have, for example, a smaller lateral cross-sectional dimension than the lateral cross-sectional dimension of the tracks 66 to allow entry of the elongate projections 62 into the tracks 66. The elongate projections 62 preferably have a lateral cross-section which includes an enlarged ball portion 68 which is joined with a reduced section 70 to the bottom surface 64 of the cover portion 60. Similarly, the tracks 66 have an enlarged circular lateral cross-section 72 which transitions into a reduced portion 74. This reduced portion has a smaller lateral cross-section than the lateral cross-section of ball portion 68. Such a design prevents the cover portion 60 from being removed by lifting in a direction perpendicular to the top portion 76 of the cover portion 60. However, the cover portion 60 can be readily removed by sliding it along the axial direction of the elongate projections 62 until the elongate projections 62 come clear of the tracks 66. It will be recognized by one skilled in the art that various other geometric patterns may be utilized to achieve this result as long as the lateral cross-sectional enlarged ball portion 68 of the elongate projections 62 is of a larger dimension than the lateral cross-sectional reduced portion 74 of the tracks 66 Also, it should be recognized that the elongate projections 62 can be positioned along the forward edge 76 and rear edge 77 of cover portion 60 rather than along side edges 79 and 81, while the tracks 66 can be positioned along the front member 12 and back member 14 of the base portion 10 rather than along the side members 16 and 18.

The cover portion 60 is slideably received in the base portion 10 as described above until the forward edge 76 of cover portion 60 makes contact with a stop 78. This step is included in the tracks 66 which prevents further movement.

Figure 5:
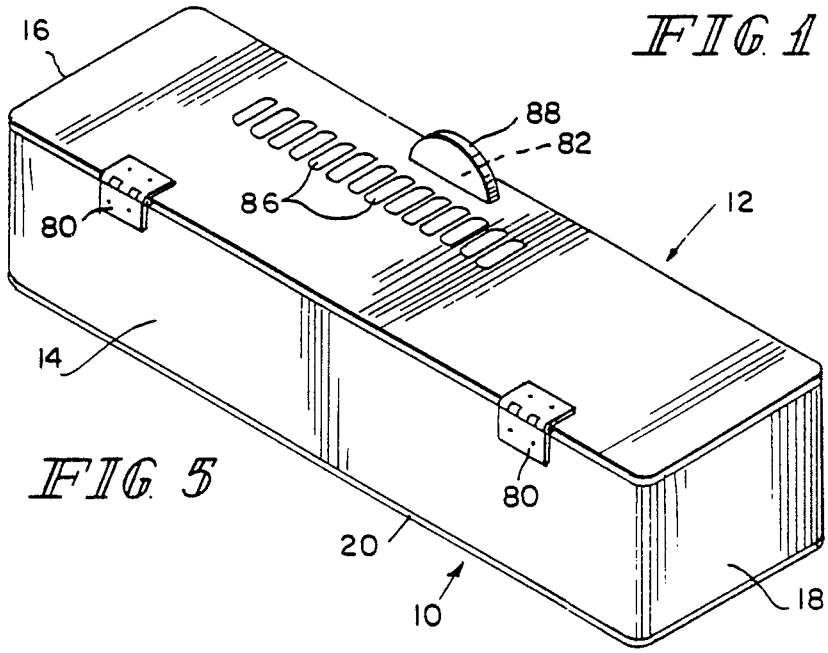
FIG. 5 is a prospective view of another preferred embodiment of the present invention, using a cover hingedly attached to the back surface of the base portion and a magnetic closure.
Figure 2:
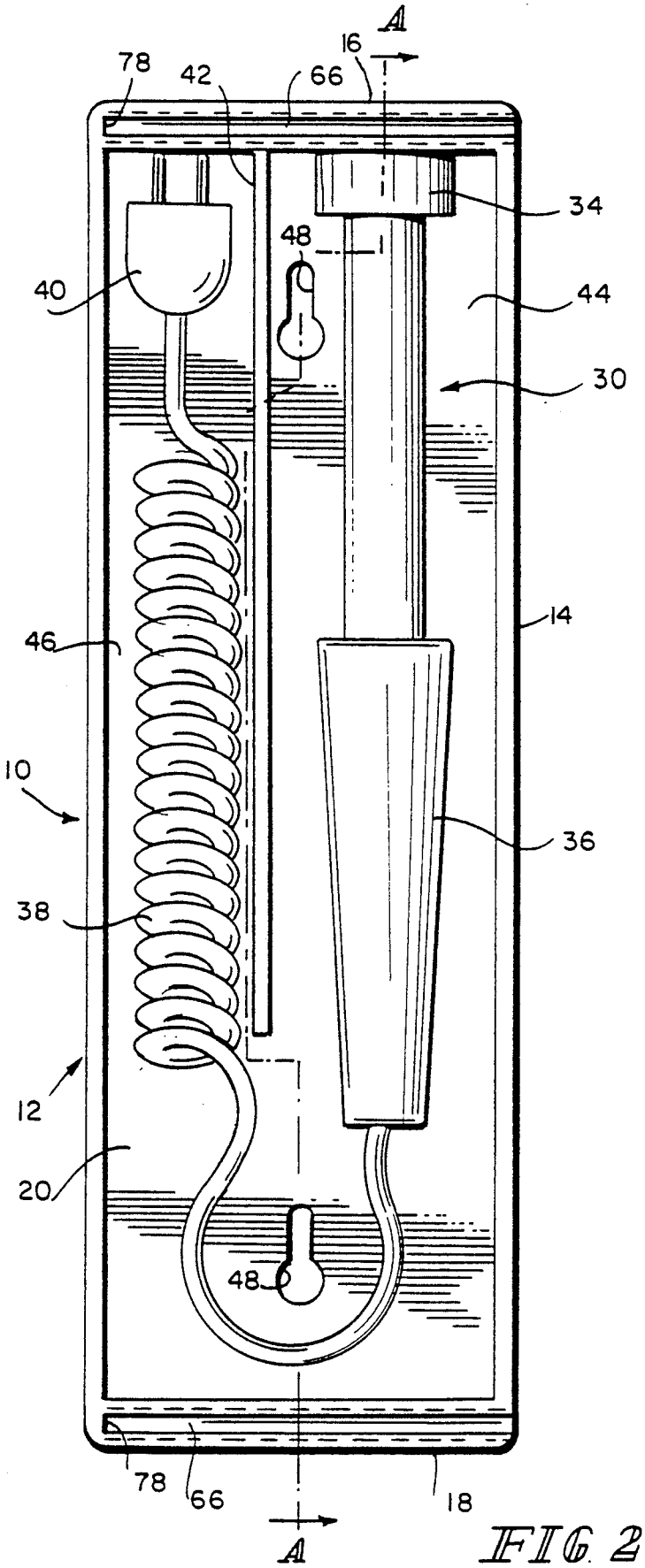
FIG. 2 is a top view of the base portion of the embodiment shown in FIG. 1.

In an alternate preferred embodiment of the present invention shown in FIG. 5, the cover portion 60 is attached by conventional hinges 80 to the back member 14 of base portion 10 and the rear edge 77 of the cover portion 60. A magnet 82 is, for example, attached near the forward edge 76 on the bottom surface 64 of the cover portion 60 and engages a closure member 84 made of steel or other magnetic material attached near the top of front member 12 of the body portion 10 to securely close the cover portion 60 onto the base portion 10. It can now readily be seen by one skilled in the art that the hinges 80 may be mounted alternately on front member 12 or on one of side members 16 and 18 of base portion 10 along with the corresponding edge of cover portion 60. Further alternate closure mechanisms include a hook and loop closure means commonly distributed under the tradename VELCRO.

In preferred embodiments, a series of angled openings or louvers 86 are included through the cover portion 60 to allow ventilation and air circulation between the interior of the enclosure and the exterior environment. A handle 88 is attached to the top surface 90 of the cover portion 60 to assist in the assembly and removal of the cover portion 60.

In preferred embodiments, the body portion 10, cover portion 60, partition member 42 and cylindrical retension member 56 are fabricated from a transparent plastic such as the polycarbonate resin marketed as Lexan 141, a trademark of General Electric Company, to allow the user to view the contents of the enclosure without removal of cover portion 60. However, it will be recognized by one skilled in the art that other materials such as other transparent or opaque polymers may readily be utilized to fabricate any or all of these components. It may also be desireable in particular embodiments to use more heat resistant materials, particularly where portions of the enclosure are in direct contact with the heating element of the curling iron.

To install the base portion 10 to a wall or other vertical surface 50, the curling iron 30 is first removed from the base Portion 10. Screws or other fasteners 52 are then inserted through the mounting holes 48 and tightened to secure base portion 10 to the wall or other vertical surface 50. To secure the curling iron 30 in the base portion 10, the clip 54 is either removed from partition member 42, or wing members 57 and 58 are pivoted upwardly away from floor member 20 and the free or tip end 34 of the elongate heatable element 32 is positioned inside cylindrical retention member 56. The heat insulated handle 36 is then pressed towards floor member 20 of base portion 10. The insulated electrical power cord 38 and electrical outlet plug 40 are next positioned through the opening between the side member 18 and the partition member 42 and into the second section 46 of the base portion 10. The clip 54 is then either reattached to the partition member 42 or the wing members 57 and 58 are allowed to spring back to their normal position.

The cover portion 60 is subsequently attached by aligning the elongate projections 62 with the tracks 66 and pushing the cover portion 60 along the tracks 66 until the forward edge 76 of the cover portion 60 contacts the stop 78 in the body portion 10. Alternatively, the cover portion 60 may be pivoted along hinges 80 until the cover portion 60 contacts the base portion 10 and magnet 82 engages with closure member 84.

From the preceding description of the preferred embodiments, it is evident that the objects of the invention are attained by the present invention. Although this invention has been described and illustrated in detail, it is to be clearly understood that the same is by way of illustration and example only and is not to be taken by way of limitation. The spirit and scope of this invention are to be limited only by the terms of the appended claims.

What is claimed is:

1. An enclosure storing a curling iron, comprising:
a front member having a top and a bottom;
a back member having a top and a bottom;
a first side member having a top and a bottom;
a second side member having a top and a bottom;
a floor member attached to said bottom of said front member, to said bottom of said back member, to said bottom of said first side member and to said bottom of said second side member;
a partition member attached to at least one of said first side member and said floor member;
a first section on a first side of said partition member receiving a handle of said curling iron, said handle having a first end and a second end, and receiving an elongate heatable element of said curling iron, said elongate heatable element having a mounted end attached to said first end of said handle and a free end;
a second section on a second side of said partition member receiving an electrical power cord fixedly attached to said second end of said handle of said curling iron;
a cover removably attached to said top of said front member, to said top of said back member, to said top of said first side member, and to said top of said second side member; and
said cover includes ventilation means for providing air circulation between the exterior and the interior of said enclosure.

2. The enclosure for storage of a curling iron of claim 1, further comprising;
a retaining means for securing said free end of said elongate heating element; and
a mounting means for securing said enclosure on a wall or other vertical surface.

3. The enclosure for storage of a curling iron of claim 2, wherein:
said retaining means consists of a truncated cylindrical element mounted on said first side member.

4. The enclosure for storage of a curling iron of claim 1, wherein:
said cover is pivotally attached to one of said front member, said back member, said first side member and said second side member.

5. The enclosure for storage of a curling iron of claim 1, wherein:
said ventilation means include a plurality of louvers located in said cover.

6. The enclosure for storage of a curling iron of claim 5, wherein:
said cover includes a handle means for opening and closing said cover.

7. A combination of a curling iron and an enclosure of same, comprising:
a handle with a first end and a second end;
an elongate heatable element having a free end and a mounted end attached to said first end of said handle;
an electrical power cord fixedly attached to and extending from said second end of said handle;
a front member;
a back member;
a first side member;
a second side member;
a floor member attached to each of said front member, said back member, said first side member and said second side member; and
partitional means separating said handle and said elongate heatable element from said electrical power cord within said enclosure.

8. The combination of a curling iron and an enclosure of claim 7, wherein:
said partitional means includes a partition member mounted on at least one of said floor member and said first side member.

9. The combination of a curling iron and an enclosure of claim 7, further comprising:
a first section on a first side of said partition member for receiving said handle and said elongate heating element; and
a second section on a second side of said partition member for receiving said electrical power cord.

10. The combination of a curling iron and an enclosure of claim 9, further comprising:
a retaining means for securing said free end of said elongate heatable element; and
a mounting means for securing said enclosure to a wall or other vertical surface.

11. The combination of a curling iron and an enclosure of claim 10, wherein:
said retaining means consists of a truncated cylindrical element mounted on said first side member.

12. The combination of a curling iron and enclosure of claim 11, further comprising:
a cover removably attached to said front member, said back member, said first side member and said second side member.

13. The combination of a curling iron and enclosure of claim 12, wherein:
said cover includes an alignment means for locating said cover at a predetermined orientation to said front member, said back member, said first side member and said second side member.

14. The combination of a curling iron and enclosure of claim 13, wherein:
said cover includes at least one elongate projection which is slideably received into at least one track, said track being located in at least one of said front member, said back member, said first side member and said second side member.

15. The combination of a curling iron and enclosure of claim 14, wherein:
said track includes a stop means for preventing further motion of said elongate projection.

16. The combination of a curling iron and enclosure of claim 12, wherein:
said cover is pivotally attached to one of said front member, said back member, said first side member and said second side member.

17. The combination of a curling iron and enclosure of claim 12, wherein:

said cover includes ventilation means for providing air circulation between the interior and exterior of said enclosure.

18. The combination of a curling iron and enclosure of claim 17, wherein:

said ventilation means includes a plurality of louvers located in said cover.

19. The combination of a curling iron and enclosure of claim 18, wherein:

said cover includes a handle means for opening and closing said cover.

20. An enclosure storing a curling iron, comprising:

a front member having a top and a bottom;

a back member having a top and a bottom;

a first side member having a top and a bottom;

a second side member having a top and a bottom;

a floor member attached to said bottom of said front member, to said bottom of said back member, to said bottom of said first side member and to said bottom of said second side member;

a partition member attached to at least one of said first side member and said floor member;

a first section on a first side of said partition member receiving a handle of said curling iron, said handle having a first end and a second end, and receiving an elongate heatable element of said curling iron, said elongate heatable element having a mounted end attached to said first end of said handle and a free end;

a second section on a second side of said partition receiving an electrical power cord attached to said second end of said handle of said curling iron;

a cover removably attached to said top of said front member, to said top of said back member, to said top of said first side member, and to said top of said second side member; and said cover includes at least one elongated projection which is slideably received into at least one track, said track being located in at least one of said top of said front member, said top of said back member, said top of said first side member and said top of said second side member.

21. The enclosure for storage of a curling iron of claim 20, wherein:

said track includes a stop means for preventing further motion of said elongate projection.

* * * * *